US006406596B1

(12) United States Patent
Meschenmoser

(10) Patent No.: US 6,406,596 B1
(45) Date of Patent: Jun. 18, 2002

(54) PRESS ROLL PRESS SYSTEM HAVING SAME AND METHOD OF TREATING A FIBROUS MATERIAL WEB USING SAME

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/290,260

(22) Filed: Apr. 13, 1999

(30) Foreign Application Priority Data

Apr. 15, 1998 (DE) ..... 198 16 673

(51) Int. Cl.[7] ..... D21F 3/02
(52) U.S. Cl. ..... 162/358.3; 492/7
(58) Field of Search ..... 162/203, 205, 162/206, 272, 305, 358.1, 358.3, 358.5, 359.1, 360.2, 360.3, 361, 368, 369, 373; 100/153, 162 B, 163 A; 492/5, 7

(56) References Cited

U.S. PATENT DOCUMENTS

| | | | | | |
|---|---|---|---|---|---|
| 4,518,460 | A | * | 5/1985 | Hauser et al. | 162/361 |
| 4,563,245 | A | | 1/1986 | Wanke et al. | 162/358 |
| 4,584,059 | A | * | 4/1986 | Schiel et al. | 162/361 |
| 5,084,137 | A | * | 1/1992 | Ilmarinen et al. | 162/272 |
| 5,368,697 | A | * | 11/1994 | Steiner et al. | 162/360.2 |
| 5,865,954 | A | | 2/1999 | Laapotti | 162/205 |
| 5,868,904 | A | * | 2/1999 | Laapotti | 162/360.3 |

FOREIGN PATENT DOCUMENTS

| | | | |
|---|---|---|---|
| DE | 3227768 | 1/1984 | D21F/3/02 |
| DE | 3317455 | 11/1984 | D21F/3/02 |
| DE | 3607941 | 5/1987 | B30B/9/20 |
| DE | 8805966 | 10/1989 | D21F/3/04 |
| DE | 9114699 | 3/1992 | D21F/3/02 |
| DE | 9203395 | 6/1992 | D21F/3/02 |
| DE | 9206340 | 9/1992 | D21F/3/00 |
| DE | 4321399 | 11/1993 | D21F/3/02 |
| DE | 29602948 | 6/1996 | B21B/27/02 |
| DE | 4444892 | 7/1996 | F16C/13/00 |
| DE | 19633958 | 10/1997 | D21F/3/10 |
| DE | 29712682 | 11/1997 | D21F/3/00 |
| DE | 29723115 | 5/1998 | D21F/2/00 |
| DE | 19713645 | 10/1998 | B65H/20/10 |
| DE | 29811048 | 10/1998 | D21F/3/02 |
| GB | 2182367 | 5/1987 | D21F/3/02 |
| WO | 82/02567 | 8/1982 | D21F/3/02 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Press roll, system and method for the treatment of a fibrous material web. The press roll forms at least one nip with a respective mating surface and comprises a non-rotatably mounted carrier, a press sleeve surrounding the carrier, and at least one outer support device disposed between the carrier and the press sleeve, the press sleeve being supported against the carrier at a respective press nip. The press roll additionally comprises a sagging control system to control the sagging of the carrier. The system additionally provides first and second mating rolls that form respective first and second nips with the press roll. A method of treating a material web comprises guiding the web along a felt through the press roll and mating rolls.

55 Claims, 6 Drawing Sheets

10
12
14
16
18
20
22
24
26
28
30
32
34
36
38
40
42
44
46
50
52
54
56
58
72
74
76
99
L
P
S1
S2
S3

PRESS ROLL PRESS SYSTEM HAVING SAME AND METHOD OF TREATING A FIBROUS MATERIAL WEB USING SAME

CROSS-REFERENCE TO RELATED APPLICATIONS

The present application claims priority under 35 U.S.C. §119 of German Patent Application No. 198 16 673.7, filed on Apr. 15, 1998, the disclosure of which is expressly incorporated by reference herein in its entirety.

BACKGROUND OF THE INVENTION

1. Field of the Invention

The invention concerns a press roll and more particularly, a press roll and press system having a press roll for the treatment of a fibrous material web such as a paper or cardboard web, in at least one press nip.

2. Discussion of Background Information

Press rolls are known in the related art. One such press roll is mentioned in German Patent Application No. DE-U-92 03 395. This press roll is a shoe press roll, and the press sleeve is also supported in a known manner by at least one support device against a solid stationary yoke, which serves as a flexural carrier and is thus bent according to the varying load. Sagging of the yoke may, however, have a disadvantageous effect on the shoe and guidance of the sleeve. It is often advantageous for deviations from a starting position of this shoe and sleeve guidance to occur. In the press roll of the related art, the effect of sagging of the yoke perpendicular to the plane of the press is countered in that the press shoe is movable relative to the yoke. -However, adequate positional stability of the shoe and sleeve guidance has heretofore not been possible. This is especially true for situations when, for example, a press roll is used as a central roll between two additional press rolls and, consequently, the supporting forces act in different directions.

German Patent Application No. DE-A-33 17 455 discloses a known press roll whereby the press sleeve surrounds a non-rotatably mounted hollow carrier, which is supported internally against an inner flexural carrier by a support device. However, this press roll lacks an outer support device enabling variable adjustment of the support forces positioned between the outer carrier and the inner carrier.

It is thus desirable to provide a press roll and press system having a press roll that has none of the aforementioned difficulties.

SUMMARY OF THE INVENTION

The present invention provides a press roll, system and method for the treatment of a fibrous material web. The press roll of the present invention forms at least one nip with a respective mating surface, and comprises a non-rotatably mounted carrier, a press sleeve surrounding the carrier, and at least one outer support device disposed between the carrier and the press sleeve, the press sleeve being supported against the carrier at a respective press nip. The press roll also has a sagging control system adapted to control the sagging of the carrier. The sagging control system may also compensate for sagging produced by the forces in the region of the press nip. Two outer support devices may be provided, with a space extending therebetween in a circumferential direction of the press roll. Additionally, the press sleeve may also be supported against the carrier, to form at least two press nips with respective mating surfaces.

According to an aspect of the invention the carrier may be a bimetal carrier and the sagging control system may further provide a heating system to heat the carrier. Furthermore. The carrier may be slotted and a brace may also be provided to brace the slotted carrier. Additionally, a mutual radial bracing device to brace the carrier and the inner carrier may also be provided. The mutual radial bracing device may brace the carrier and the inner carrier by hydraulics, pneumatics, mechanics, thermal, and/or electromagnetics. Alternatively, the carrier may be an outer hollow carrier having a non-rotatably mounted inner carrier disposed therein.

The sagging control system may include an inner support device disposed between the hollow carrier and the inner carrier. The inner support device may include a group of inner support device support elements perpendicularly extending relative to a direction of travel of the web. Furthermore, the hollow carrier and the inner carrier may each be mounted on their respective ends at a point equidistant from each other.

In accordance with another aspect of the invention, the press sleeve may be a flexible press sleeve and be designed as a shoe press roll. The outer support device may further comprise at least one press shoe and a plurality of outer support device support elements disposed in a group perpendicularly extending relative to a direction of travel of the web. Additionally, the inner support device may include at least one group of inner support device support elements perpendicularly extending relative to a direction of travel of the web, and the inner carrier support elements and the outer support device support elements may each include at least one cylinder/piston unit.

The press roll may also comprise at least one inner support device disposed between the carrier and the inner carrier, with the inner support device being configured to apply a force and act in a predetermined direction, wherein the sagging control system controls sagging of the carrier and wherein sagging resulting from different directional pressing forces is compensated. Also, at least two nips may be included. The two outer support devices may also be disposed between the carrier and the press sleeve.

According to yet another aspect of the invention, the direction of action of the inner support device lies in a resultant direction of action of the two outer support devices. Furthermore, each force applied by the two outer support devices may have the same magnitude. Additionally, each of the two outer support devices may be configured to act in a radial direction offset by approximately 120°. The forces applied by the two outer support devices and the force applied by the inner support device may be at least substantially of the same magnitude and form an equilateral triangle of forces.

The group of outer support device support elements and the inner support device may further have the same pitch and may each have pistons having the same piston area. The forces applied by the two outer support devices may be the same magnitude and form an isosceles triangle of forces with the force applied by the inner support device. Furthermore, the total piston area of the inner support device may generate a force at least substantially compensating the force resulting from the two outer support devices. The group of support elements of the two outer support devices may have the same pitch and the support element pistons may have the same piston area. Also, the total piston area of the inner support device may generate a force at least substantially compensating the force resulting from the two outer support devices. The individual piston areas of the inner support device support elements may be the same size as the individual piston areas of the support elements of the two outer support devices. The total piston area of the inner support device may be determined by the number of the inner support device support elements.

The piston pitch spacing of the inner support devices may be the same as that of the two outer support devices wherein the total piston area of the inner support device may be determined by the size of the individual piston areas. Also, the direction of action of the inner support device may lie in the bisector of the angle between the radial directions of action of the two outer support devices. Furthermore, the forces applied by the two outer support devices may have different magnitudes and may form a scalene triangle of forces with the forces applied by the inner support device. The group of support elements of the two outer support devices may have an unequal pitch and/or different sized piston areas. Additionally, the entire piston area of the inner support device may generate a force at least substantially compensating for the force resulting from the two outer support devices.

According to still another aspect of the invention, each of the two outer support devices comprises at least one press shoe, each press shoe having an equal width extending in the direction of travel of the web. Additionally, the two outer support devices and the inner support device may each have variably adjustable pressure. Sleeve guide rails disposed intermediate the carrier and the press sleeve may also be included, wherein the forces applied by the two outer support devices and the inner support device may be maintained in equilibrium by individual pressures acting on the outer support device support elements and the sleeve guide. Furthermore, the press sleeve may be guided offset relative to the carrier.

Another aspect of the invention provides a press roll that comprises a press sleeve, and a hollow outer carrier having opposed ends secured against torsion; the carrier is disposed within the press sleeve and is adapted to guide the press sleeve. Also provided is a support device adapted to internally support the press sleeve at the at least one press nip, and an inner carrier disposed within the outer carrier. The press sleeve is supported against the inner carrier directly through the hollow carrier sleeve by the support device.

The press sleeve may additionally be flexible. The support device may comprise a support element and a press shoe for guidance on the hollow carrier, with the press shoe being supported directly against the inner carrier by the support element, which may be coupled to the press shoe by a joint. The support device additionally may exert a variably adjustable supporting force. Furthermore, the hollow carrier and the inner carrier may be mounted on their respective ends and at a location equidistant from each other.

Additionally, two support devices and two press nips may be provided, the two press nips defining a space therebetween in the circumferential direction. Each of the two support devices may exert a variable and separately adjustable supporting force. The press sleeve may be in the form of a polygon at at least a section of the press sleeve, at least between the two elongated press nips. Further, the press sleeve may be blind drilled and/or grooved.

The system of the present invention provides a shoe press roll, a first mating roll and a second mating roll, wherein the shoe press roll mates with the first mating roll to form a first press nip therebetween, and the shoe press roll mates with the second mating roll to form a second press nip therebetween, the first press nip and the second press nip elongated in a direction of travel of the web. The web path may be completely closed. Furthermore, the system may further comprise a felt adapted for guidance between the first and second press nips. Also, a pickup felt for guidance through the first and/or press nip may also be provided.

Another aspect of the system provides a deflecting roll, wherein the web is guided therearound. The deflecting roll may also be a suction roll. Also, a drying section may be provided. At least one of the press nips may be double felted. The press sleeve, the first mating roll and the second mating roll may be blind drilled and/or grooved. At least one press nip may be adapted for drainage at least partially by centrifugation into at least one channel.

The system may further comprise an offset roll, where the second mating roll forms a third press nip therewith. The offset roll may be a shoe press roll, and the third press nip may be elongated in the direction of travel of the web. The second mating roll may be heated to facilitate the drainage of the web in the second press nip and the third press nip, and to further facilitate the release of the web from the second mating roll. A heating system may also be provided to heat the deflecting roll, thereby increasing drainage performance of the second press nip.

According to still another aspect of the system, a press roll is disclosed wherein the press sleeve is supported against the inner carrier directly through the hollow carrier sleeve by the support device, a first mating roll, and a second mating roll. The shoe press roll mates with the first mating roll to form a first press nip therebetween, and the shoe press roll mates with the second mating roll to form a second press nip therebetween, the first press nip and the second press nip are elongated in a direction of travel of the web.

The method of treating a fibrous material web comprises providing a shoe press, mating a shoe press roll to a first mating roll to form a first press nip therebetween, mating the shoe press roll to a second mating roll to form a second press nip therebetween, and guiding the web along a felt through the first and second nips. Additionally the method may further comprise guiding the web along the felt around a deflecting roll. The method may yet still comprise guiding the web along the felt through a completely closed web path.

Further, the method may further comprise draining at least one press nip, through centrifugation, into at least one channel, and may also comprise guiding the web along the felt through a third press nip formed by the second mating roll and the press roll. The second mating roll may be heated and the web may be released from the second mating roll. Furthermore, the deflecting roll may be heated and the web may be drained at the second press nip.

Another method of treating a fibrous material web comprises providing a press roll, mating the shoe press roll to a first mating roll to form a first press nip therebetween, mating the shoe press roll to a second mating roll to form a second press nip therebetween, and guiding the web along a felt through the first and second nips.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

Figures 1, 2:
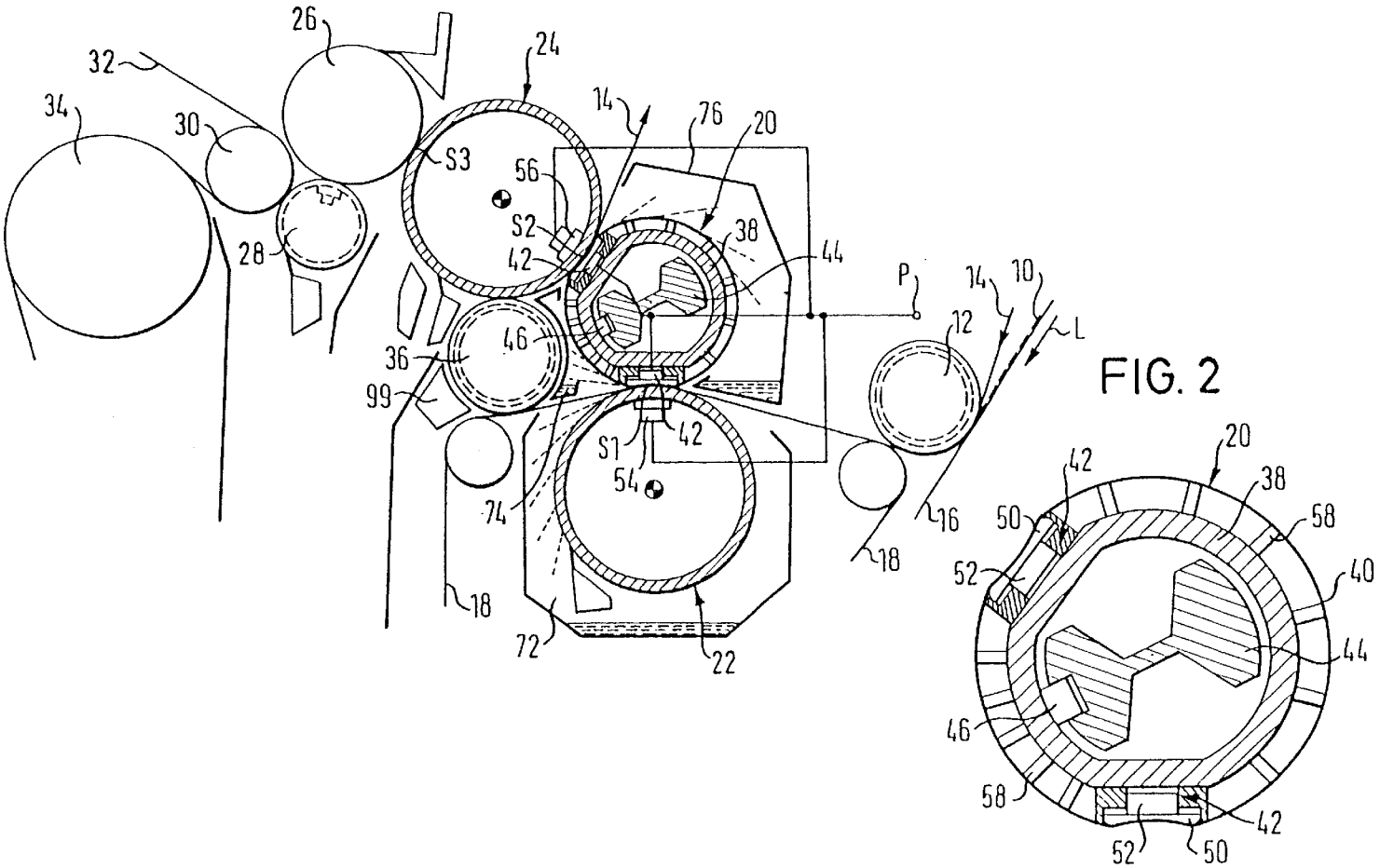
FIG. 1 is a partial schematic sectional view of a first embodiment of a press system having a central shoe press roll.
FIG. 2 is an enlarged cross-sectional view of the central shoe press roll of the press system of FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention uses a positionally stable independent press roll guide, whereby it is possible to accurately guide the web and/or felt thereover. The present invention uses a sagging control system to control the sagging of a hollow carrier. In particular, sagging of the carrier produced by the forces in the region of the press nip or press nips is compensated. Additionally, the sagging control system may be automatically compensated. A straight and positionally stable starting position is always present regardless of the pressure level set in each case. This means that no significant geometric changes in the press roll occur, even during runup and rundown of the linear force. In addition, because of the absence of beam bending, side shields of a respective press sleeve clamp do not undergo any slanting. Thus, trouble-free travel of the press sleeve of a respective press felt, and of the fibrous material web is facilitated.

The press roll may, for example, include two support devices having a space therebetween in a circumferential direction, whereby the press sleeve is supported against the carrier, to form at least two press nips with respective mating surfaces. Sagging of the carrier can be controlled such that resultant sagging produced by the different directional pressing forces is compensated.

The sagging control system may be implemented in different ways. For example, a bimetal carrier may be provided, wherein the sagging control system may also include a carrier heating system. It is, for example, also possible to use a slotted carrier and a brace disposed within the sagging control system.

Additionally, at least one inner and/or at least one outer auxiliary carrier is used in conjunction with the carrier and the sagging control system includes a device providing for a mutual radial bracing of this carrier.

In one embodiment, the carrier is provided as an outer hollow carrier, which is used in conjunction with a non-rotatably mounted inner carrier, whereby the sagging control device includes a radial brace for the hollow carrier and for the associated inner carrier. The radial brace may be, for example, hydraulic, pneumatic, mechanical, thermal, and/or electromagnetic.

If the sagging control device includes at least one support device disposed between a hollow carrier and an inner carrier, this support device preferably includes at least one group of support elements extending perpendicular to the direction of travel of the web. When a hollow carrier and an inner carrier are used, they are mounted equidistantly on their respective ends.

The press roll may be a shoe press roll with a flexible press sleeve. At least one support device disposed between the carrier and the press sleeve may include at least one press shoe as well as a plurality of support elements disposed in a group extending perpendicular to the direction of travel of the web, which may be formed, for example, by respective cylinder/piston units. The support elements of a support device may be disposed between a hollow carrier and an inner carrier, and may also include such cylinder/piston units.

The press roll may also include two outer support devices disposed between the hollow carrier and the press sleeve, with a space therebetween in the circumferential direction. The press sleeve is thus supported against the hollow carrier in the region of two press nips to be formed with a respective mating surface, as well as at least one inner support device disposed between the hollow carrier and the inner carrier, whereby the sagging of the hollow carrier can be controlled such that sagging of the hollow carrier produced by the different directional pressing forces is reduced. The direction of action of the inner support device preferably lies in the resultant direction of action of the two outer support devices.

When the supporting forces applied by the two outer support devices are of at least substantially the same size and the radial directions of action of the two outer support devices are offset by approximately 120°, all three forces applied by the two outer support devices and the inner support devices may be substantially the same size, such that an equilateral triangle of forces results. In such a case, the groups of support elements of the two outer support devices, and groups of support elements of the inner support device can have the same pitch and the same piston areas. The two outer support devices and the inner support device may then, for example, be acted upon by the same preferably variably adjustable pressure. The forces generated by the two outer support devices and the inner support device are thus in equilibrium, whereby the direction of action of the inner support device lies in the bisector of the angle between the two radial directions of action of the two outer support devices.

In another embodiment of the invention, when the forces applied by the two outer support devices are at least substantially of the same size, they form an isosceles triangle of forces with the force applied by the inner support device. In this case, the group of support elements of the two outer support devices can again have the same pitch and piston areas as groups of support elements of the inner support device. To generate a force that compensates for resulting force of the two outer support devices, the entire piston area of the inner support device is adapted accordingly. This adaptation may, for example, take place through the number of support elements, whereby the individual piston areas of these support elements associated with the inner support device are preferably of the same size as the individual piston areas of the support elements of the two outer support devices. The groups of pistons of the two outer support devices as well as the inner support device may again be acted upon by the same, preferably variably adjustable pressure. The direction of action of the inner support device lies in the bisector of the angle between the two radial directions of action of the two outer support devices. All forces are thus in equilibrium, but a small deviation may exist due to the selected total pitches in the group of support elements of the inner support device.

In the press roll having an isosceles triangle of forces, in which the total piston area of the inner support device is adapted to generate a force that at least substantially compensates for the resultant force of the two outer support devices, the total area can be adapted by the size-of the individual piston areas. The group of support elements of the inner support device has the same pitch as the group of support elements of the two outer support devices. All groups of support elements can also be acted upon by the same, preferably variably adjustable pressure. In addition, the direction of action of the inner support device lies in the bisector between the two radial directions of action of the two outer support devices. A small-percentage deviation may-exist due-to the selected standard piston diameter in the group of support elements associated with the inner support device, which may not entirely conform to the calculated diameter. Nonetheless, all forces are in equilibrium.

It is also possible for the forces applied by the two outer support devices to be of different sizes and to form a scalene triangle of forces with the force applied by the inner support device. In such a case, the groups of support elements of the two outer support devices have an unequal pitch and/or their support elements have piston areas of different sizes. Also, the total piston area of the inner support device may be adapted to generate a force at least substantially compensating for the resultant force of the two outer support devices. Since the forces applied by the two outer support devices are of different sizes, in the present case, the direction of action of the inner support device does not line up with the bisector of the angle between the two radial directions of action of the two outer support devices. The two outer support devices as well as the inner support device may be acted upon by the same, preferably variably adjustable pressure. As a result, all forces are in equilibrium. Moreover, in this case, the pressure shoes may have the same width viewed in the direction of travel of the web. This arrangement results in the advantage that only one reserve shoe is necessary.

In another arrangement of the press roll according to the invention, the forces applied by the two outer support devices in the inner support device are kept in equilibrium by the individual pressures acting upon the support elements. In this arrangement, the directions of action of the various support devices, as well as the piston areas, and pitches or the distances between the support elements are freely selectable. In the arrangements having an equilateral or isosceles triangle of forces, the pressure profile developing in the various press nips can be adapted as needed by selecting an appropriate shoe width, measured in the direction of travel of the web. The pressure shoes may be equipped with a double-piston pressure system to vary the pressure curve in the press nips.

Another advantage of the press roll according to the invention is that the press sleeve may be offset relative to the hollow carrier viewed in the cross-sectional plane of the press roll, whereby greater shoe widths are possible. Additionally, an outer hollow carrier guiding the press sleeve, and an inner carrier are provided, and the press sleeve is supported against the inner carrier directly through the hollow carrier sleeve by a support device. The support device preferably includes at least one press shoe guided on the hollow carrier and at least one support element, by which the press shoe is supported directly against the inner carrier.

The outer hollow carrier serves merely to guide the press sleeve. There is no direct transfer of press nip support forces by the hollow carrier. The hollow carrier picks up the lateral shoe support force, which corresponds to the frictional force in the corresponding press nip. Thus, the outer hollow carrier is not subjected to flexing. Rather, the hollow carrier remains straight, even during operation. The support forces are absorbed by the inner carrier, which can flex freely in all directions, without the shoe, press sleeve, felt, and/or web guidance being negatively affected thereby. The respective support devices, and thus the corresponding press nips, may separately be adjusted. Moreover, the pressure shoes may be of the same width. The support elements may have pistons located in the interior of the press roll. The thermal loading of such internal pistons is low, in comparison to direct contact of the shoes. Additionally, the support elements may each be coupled with a corresponding press shoe by a joint. The support force applied by a respective support device is usefully variably adjustable. The press sleeve is supported against the inner carrier directly through the hollow carrier sleeve. The hollow carrier and the inner carrier are preferably mounted equidistantly on their ends.

Preferably, at least two support devices are provided to support the press sleeve in the region of at least two press nips having a space between them in the circumferential direction. The support forces applied by the different support devices are preferably separately adjustable.

In the press roll according to the invention, it may be advantageous if the press sleeve has the shape of a polygon, at least in segments, preferably at the segment between the two elongated press nips. A polygonal sleeve-design supports the centrifuging of water from the press sleeve. A water doctor (scraper) is advantageously no longer required, resulting in less space being utilized. Furthermore, a polygonal sleeve design does not affect the service life of the sleeve. If at least part of the drainage is to take place by centrifuging of water, the press sleeve of the press roll according to the invention is preferably blind drilled and/or grooved.

The press roll according to the invention is preferably designed as a shoe press roll with a flexible press sleeve. The flexible press sleeve is advantageous in such a press system when it is used as a central roll between two other press rolls to form a press nip elongated in the direction of travel of the web with each of the two other press rolls. Thus, the need for an expensive press suction roll is eliminated.

In a press system according to the present invention, drainage many entirely take place by the two elongated press nips formed with a central shoe press roll. However, another elongated press nip may be provided in the press system, which is formed, for example, between a mating roll operating with the central shoe press roll, and another roll, in particular a shoe press roll. Thus, a maximum of three press nips are adequate, whereby volume-saving drainage may occur. The first press nip may be double felted, whereby symmetric drainage is achieved. The second press nip is usually single felted, whereby low-remoistening drainage is ensured in this nip. The problems resulting from sagging in the prior art multiroll presses are virtually eliminated by the design according to the invention. The use of cambered rolls is also no longer necessary. Instead, the present invention may use cylindrical rolls. Harder roll coatings may also be used, which have increased service lives as well as increased availability. Additionally, fewer types of rolls have to be stocked.

The mating roll forming the first elongated press nip therewith may also be blind drilled and/or grooved, such that at least partial drainage of both elongated press nips can take place by the centrifuging of water into channels. In particular, two-sided drainage of the first elongated press nip is possible by the centrifuging of water into a respective channel. Thus, lighter felts may be used. Moreover these felts are simpler to condition, which results in less vacuum required by tubular suction boxes or the like. In the present invention, only two felts are required instead of three.

Given that in the present invention, large press suction rolls having thick sleeves are eliminated, less vacuum is required. Overall, less drive power is required in the system. Moreover, simple, leverless, compact support is possible in the present invention. There is additionally a closed application of force at each press nip. Since the entire pressing load can be supplied by a common pressure line, safe and simple machine control is also possible. Overall, clearly reduced operating costs result.

In the press system according to the invention, a completely closed web path is provided. The fibrous material web can be guided around a deflecting roll designed preferably as a suction roll between the two elongated press nips formed with the shoe press roll.

It is particularly advantageous if a transfer felt or belt is guided through the second elongated press nip, further guiding the fibrous material web downstream of the second elongated press nip along with this transfer felt or belt by a deflecting roll, preferably designed as a suction roll, preferably to a downstream drying section.

As mentioned supra, the press sleeve of the press roll and/or at least one of the press rolls forming an elongated press nip with the shoe press roll may be blind drilled and/or grooved. Thus, the drainage of at least one elongated press nip can at least partially occur through centrifuging of water into at least one channel or the like. This arrangement advantageously results in a closed web path, at least two shoe presses without a press suction roll, and press nip drainage, particularly by the centrifuging of water.

Referring to the drawings wherein like numerals represent like elements, FIG. 1 shows a partial schematic sectional view of a press system for the treatment of a fibrous material web 10 according to a first embodiment. The web 10 is picked up at a region of a suction roll 12 by a top felt 14 of a wire 16, and is then fed between the top felt 14 and a bottom felt 18 into a first press nip S1 perpendicularly elongated in the direction of travel L of the web. Subsequently, the fibrous material web 10 is fed together with the top felt 14 into a second press nip S2 perpendicularly elongated in the direction of travel L of the web.

As shown in FIG. 1, the two press nips S1 and S2 perpendicularly elongated in the direction of travel L of the web are each formed in the region of the press nip S1 or S2 between a central shoe press roll 20 and first and second mating rolls 22, 24 respectively (i.e., additional press rolls) supported by respective support devices 54, 56 on a respective inside surface thereof. The mating rolls 22, 24 are sagging compensation rolls in the present embodiment. The first roll 22 is disposed directly below the central shoe press roll 20, and the second roll 24 is provided at an angle above the shoe press roll 20.

Downstream of the second press nip S2, the fibrous material web 10 is separated from the top felt 14 and is picked up by the second mating roll 24, whereupon it is fed to a downstream offset press having first and second offset rolls 26, 28. Downstream of the offset press rolls 26, 28, the fibrous material web 10 is picked up in the region of a deflecting roll 30 by a drying wire 32 and is fed to a first drying cylinder 34 of a drying section. The roll 30 may also be coupled directly adjacent to the second mating roll 24, where it may or may not form a press nip therewith.

As shown in FIG. 1, downstream of the first elongated press nip S1, the fibrous material web 10 is guided together with the top felt 14 around a suction roll 36 before it is picked up by the roll 24 and fed to the second elongated press nip S2. This arrangement results in a completely closed web path enduring until the web 10 is transferred to a drying section.

As shown in FIG. 2, the central shoe press roll 20 includes a non-rotatably mounted hollow carrier 38, a flexible press sleeve 40 surrounding the hollow carrier 38, as well as two outer support devices 42 having a space therebetween in the circumferential direction. The press sleeve 40 is supported against the hollow carrier 38 in the region of the two elongated press nips S1 and S2.

A non-rotatably mounted inner carrier 44 having a support device 46 (also referred to as a mutual radial bracing device), provides for internal support of the hollow carrier 38. The inner carrier 44 and support device 46 assist in the prevention of sagging otherwise produced by the different directional pressing forces in the region of the two elongated press nips S1 and S2. The inner carrier 44 and support device 46 are collectively referred to as a sagging control system.

Figure 3:
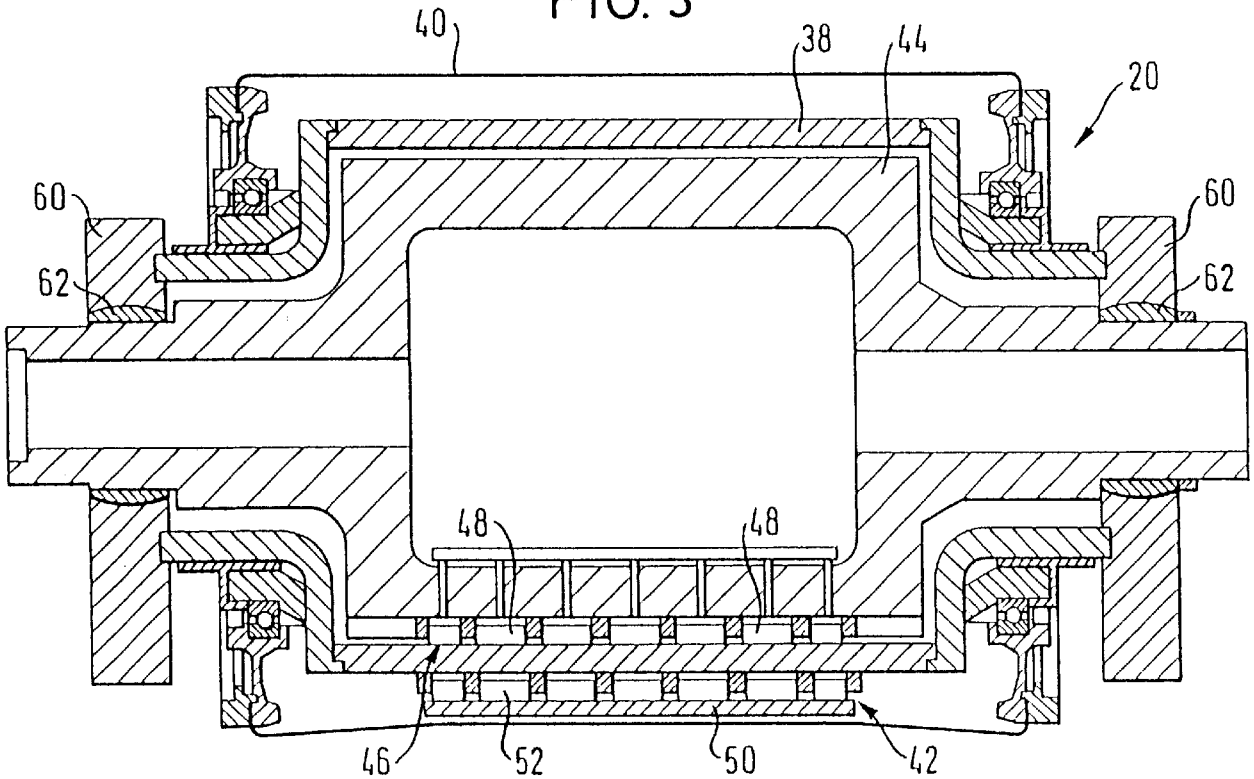
FIG. 3 is a schematic longitudinal section of the central shoe press roll shown in FIGS. 1 and 2.

As shown in FIG. 3, the inner support device 46 disposed between the hollow carrier 38 and the inner carrier 44 includes at least one group of inner carrier support elements 48 extending perpendicular to the direction of travel L of the web. Each of the two outer support devices 42 has at least one press shoe 50 and a plurality of outer support device support elements 52 disposed in a group extending perpendicular to the direction of travel of the web L. As shown in FIGS. 1–3, each of the support elements 48 and 52 include at least one cylinder/piston unit. Additionally, the direction of action of the inner support device 46 lies in the direction of action of the two outer support devices 42.

In the present embodiment, the support forces applied by the two outer support devices 42 are of at least substantially the same magnitude. The radial directions of action of the two outer support devices 42 are offset by approximately 120°. The direction of action of the inner support device 46 lies in the bisector of the angle between the two radial directions of action of the two outer support devices 42 (i.e., approximately 60°), best shown in FIG. 2. In FIG. 3, the inner support device 46 is shown radially aligned with one of the two outer support devices 42, for illustrative purposes only. However, in practice, the support devices 42, 46 are offset relative to each other by 60° in the circumferential direction.

In the present embodiment, the forces applied by the two outer support devices 42 and the inner support device 46 are of at least substantially the same magnitude, such that they form an equilateral triangle of forces. In order to achieve this, the group of support elements 52 of the two outer support devices 42, and the inner carrier support elements 48 have the same pitch. Moreover, the respective support elements 52, 48 have the same piston areas. As shown in FIG. 1, the two outer support devices 42 and the inner support device 46 may be acted upon by the same pressure P, which in the preferred embodiment may be variably adjustable. The forces applied by the three support elements 42, 46 are thus in equilibrium. As shown in FIG. 1 by dashed lines, the support devices 54, 56 that provide for inner support of the mating rolls 22, 24, respectively, may also be acted upon by the pressure P.

As best viewed in FIG. 2, sleeve guide rails 58 are also provided between the hollow carrier 38 and the press sleeve 40, whereby the press sleeve 40 is appropriately guided into regions between the press shoes 50, in the circumferential direction. As shown in FIGS. 2–3, the hollow carrier 38 and the inner carrier 44 are mounted equidistantly from each other on their ends in lateral mounts 60. The bearings of the central shoe press roll 20 and the two mating rolls 22 and 24 are each in a common plane on both respective sides.

As shown in FIG. 1, a steam blast box 99 or other heating system can be provided on the deflecting roll 36, preferably designed as a suction roll, to increase the drainage performance in the second press nip S2 and in the third press nip S3.

In the embodiment of the shoe press roll 20 shown in FIG. 3, bushings 62 are pushed onto the two ends of the inner carrier 44. The bushings 62 have a spherical outer bearing surface and are accommodated in a complementary recess of a respective mount 60 to create a ball and socket joint. Thus, the ends of the inner carrier 44 are tippable relative to the hollow carrier 38 which is stationarily mounted on the mounts 60, such that the inner carrier 44 can be freely flexed.

Figure 4:
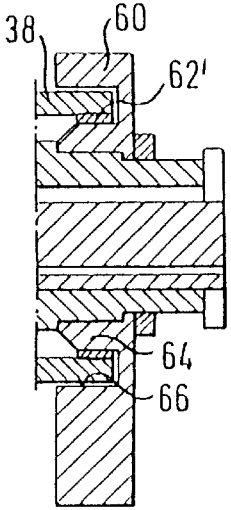
FIG. 4 is a schematic longitudinal section through the right end of the central shoe press roll shown in FIGS. 1 and 2 with an alternative mounting.

FIG. 4 depicts an alternative mounting, wherein an appropriate bushing 62' is pushed onto an axially inward extending shoulder 64 of the respective mount 60 and works with its spherical outer bearing surface with a complementary radial inward annular groove-type recess on a respective end of the hollow carrier 38. The carrier 38 and the bushing 62' is accommodated in an axial inward open annular groove 66 of the mount 60 in question. For the illustrative purposes, in FIG. 4, only the right end of the roll is shown. The mounting on the left end of the roll is complementarily configured.

By using the shoe press roll 20 as a central roll disposed between the two mating rolls 22 and 24, sagging of the hollow carrier 38 is controlled by the inner support device 46 such that sagging produced by the forces in the region of the two press nips S1 and S2 is at least substantially compensated for. Thus, the hollow carrier 38 is not exposed to bending but rather only to shell deformation.

Figure 5:
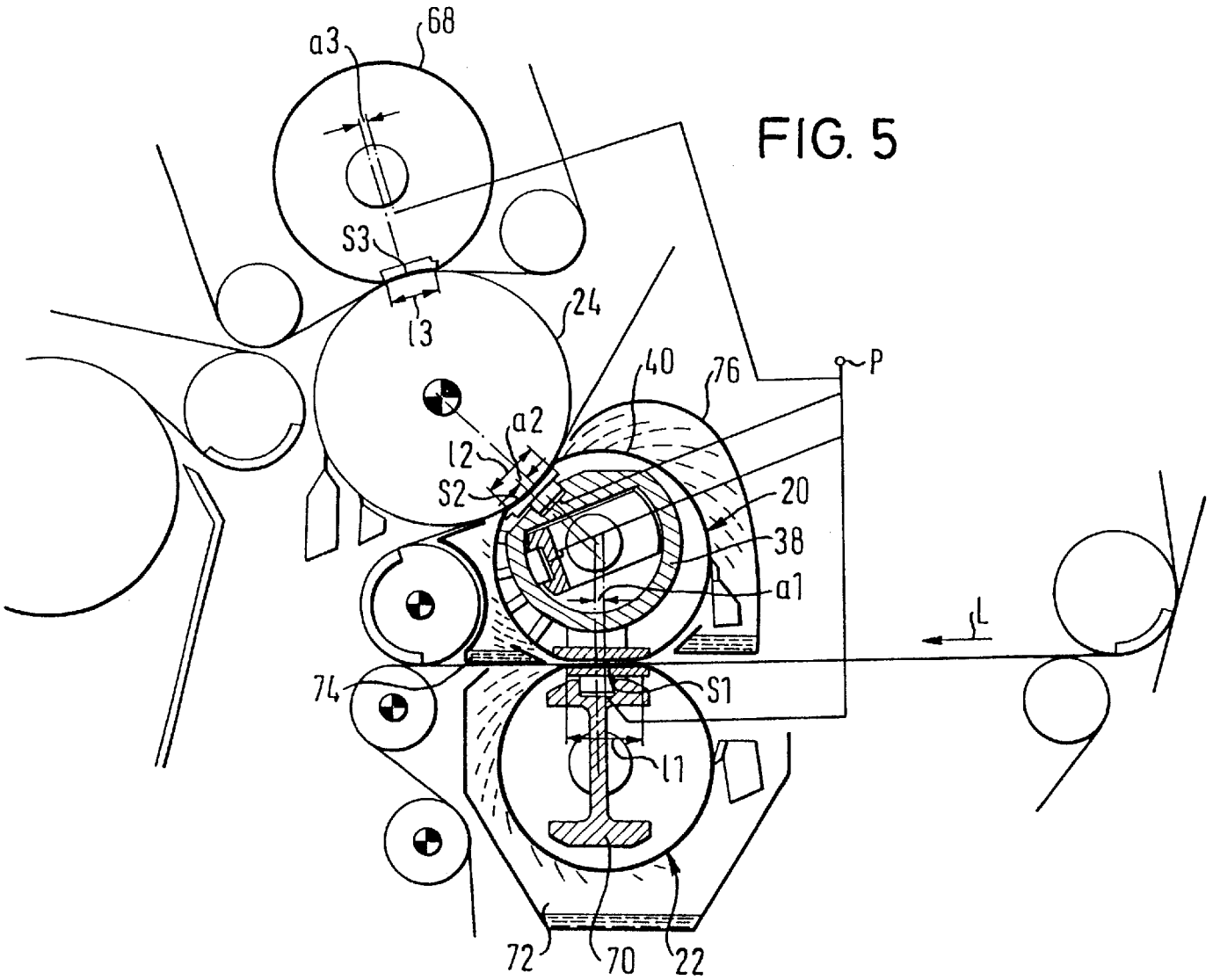
FIG. 5 is a partial schematic sectional view of another embodiment of a press system with a central shoe press roll, wherein the press sleeve is offset relative to the hollow carrier viewed in the cross-sectional plane of the roll.

FIG. 5 shows a partial schematic sectional view of another embodiment of a press system. This embodiment differs from the embodiment of FIG. 1 in that the press sleeve 40 of the central shoe press roll 20 viewed in the plane of the cross-section of the roll as shown, is guided offset relative to the hollow carrier 38, whereby larger shoe widths are possible. Additionally, the first mating roll 22 is formed by a shoe press roll. As shown in FIG. 5, a flat first press nip S1 is also provided such that in the region of this press nip S1, there is a straight felt and web passage therethrough.

Moreover, an additional shoe press roll 68 forms a third elongated press nip S3 with the mating roll 24, downstream from the elongated press nip S2 with respect to the direction of travel L of the web. Respective support devices complement the press shoes of the two shoe press rolls 22, 68, may be acted upon by the same pressure P (as shown). The mating roll 24 may be formed, for example, by a solid roll.

In FIG. 5, the offset of the press sleeve 40 relative to the press plane of the press nip S1 is indicated by a1, and the offset of the press sleeve relative to the press plane of the press nip S2, by a2. The press sleeve of the bottom shoe press roll 22 is offset relative to the yoke 70 of this roll by the value a1. Moreover, the press sleeve of the top shoe press roll 68 is offset relative to the yoke thereof, by the amount a3.

In addition, the embodiment according to FIG. 5 has at least substantially the same structure as that of the embodiment of FIG. 1. Thus, in both cases, a completely closed web path is provided. Additionally, both the central shoe press roll 20 and the first mating roll 22 are in each case blind drilled and/or grooved, to enable drainage of the two press nips S1 and S2 by centrifuging of water into respective channels 72, 74, and 76. As can be seen in FIGS. 1 and 5, such drainage takes place downstream of the first elongated press nip S1 on both sides by centrifuging of water, whereby channels 72 and 74 disposed on opposite sides are provided. In contrast, the channel 76 serves for drainage of the second elongated press nip S2. Thus, less drainage is required to be performed by the felt. To support the centrifuging of water from the press sleeve 40 of the shoe press roll 20, in the embodiments shown, the press sleeve 40 is in the form of a polygon between the two elongated press nips S1 and S2.

Figure 6:
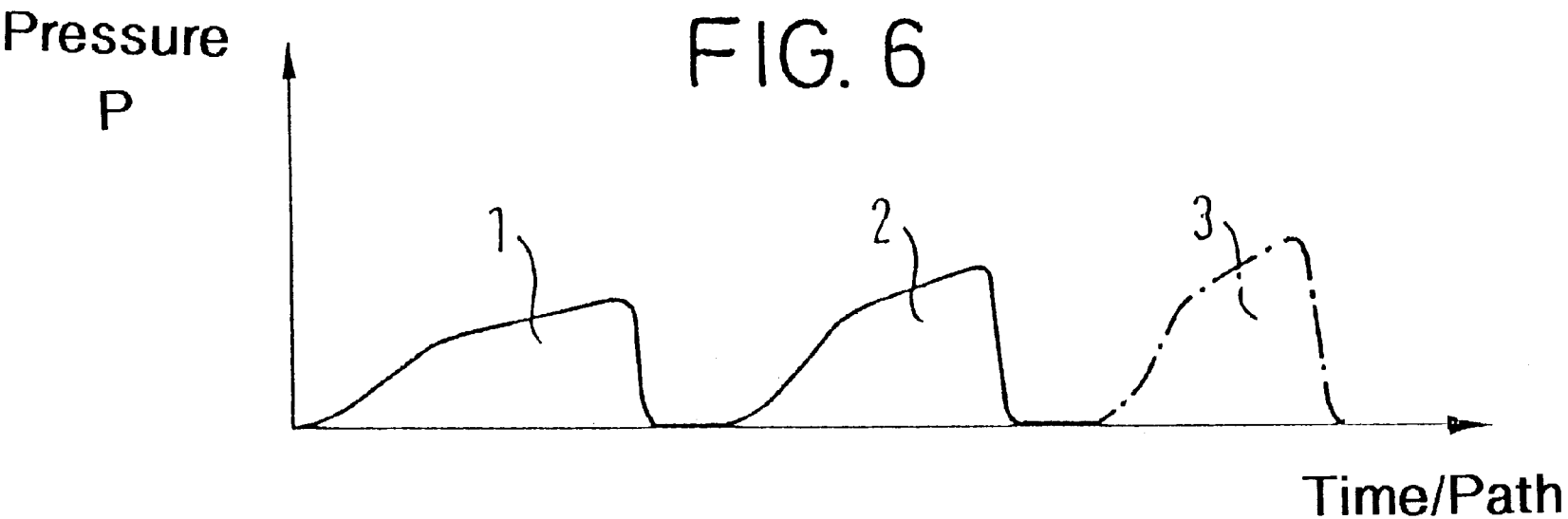
FIG. 6 is a graph of the pressure curve in the direction of travel of the web over the press nips of the embodiments according to FIGS. 1 and 5.

FIG. 6 is a diagram showing the pressure curve resulting in the direction of travel L of the web over the two press nips S1 and S2 of the embodiment according to FIG. 1 and the press nips S1 through S3 of the embodiment according to FIG. 5, respectively. In the diagram, the pressure P is shown as a function of time/path. An adaptation of the pressure profile may take place through the selected shoe widths 11 and 12 and 11 through 13, respectively, as shown in FIG. 5. The pressure can increase continuously over the two or three consecutive elongated press nips in the direction of travel of the web L, which results in a continuous increase in pressing performance.

Figure 7:
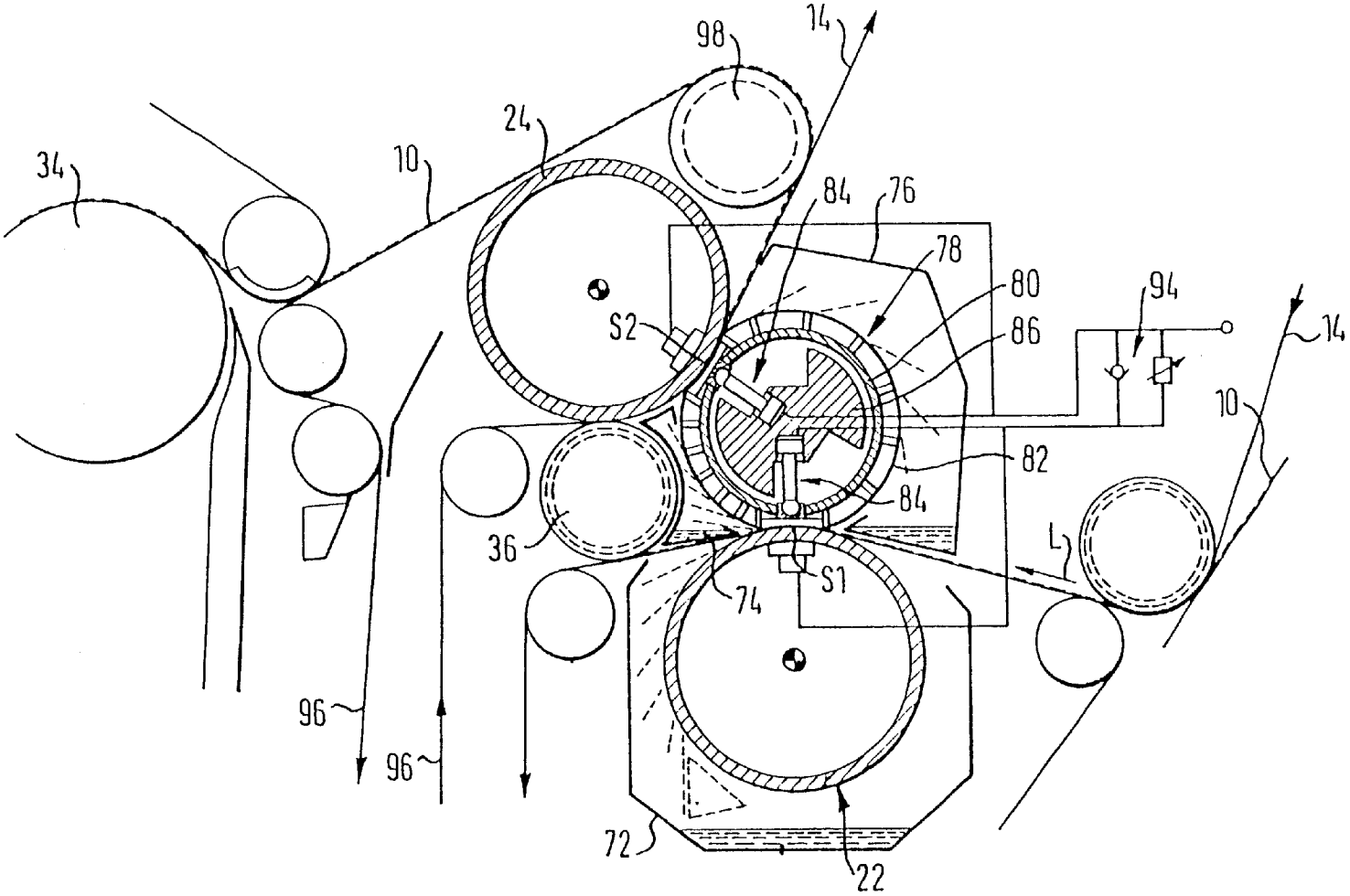
FIG. 7 is a partial schematic sectional view of a third embodiment of a press system having a central shoe press roll.

FIG. 7 shows a partial schematic sectional view of a third press system with a third embodiment of a central shoe press roll 78. As with the press system shown in FIG. 1, the central shoe press roll 78 forms two press nips S1 and S2 elongated in the direction of travel L of the web, with two mating rolls 22 and 24 provided here as sag compensation rolls, which are also drained by centrifuging of water into channels 72, 74, and 76.

Figure 8:
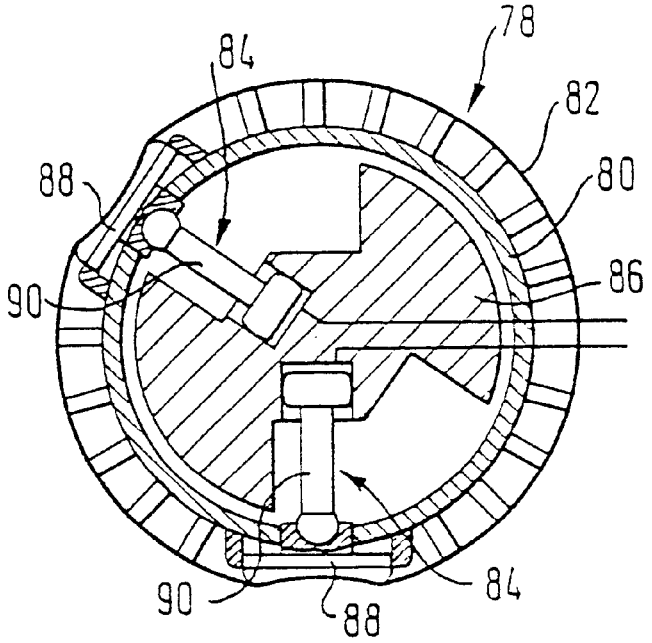
FIG. 8 is an enlarged cross-sectional view of the central shoe press roll of the press system shown in FIG. 7.
Figure 9:
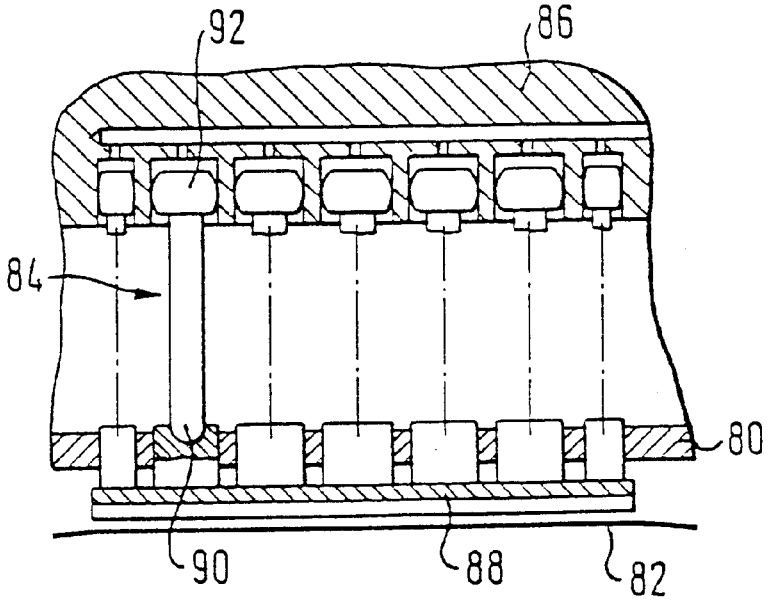
FIG. 9 is a schematic longitudinal section through the central shoe press roll shown in FIGS. 7 and 8.

As shown in FIGS. 8 and 9, the central shoe press roll 78 includes an outer hollow carrier 80 secured against torsion on its ends, a flexible press sleeve 82 surrounding the hollow carrier 80, as well as two support devices 84, whereby the press sleeve 82 is supported internally in the region of two press nips S1 and S2. A non-rotatably mounted inner carrier 86 is disposed within the outer hollow carrier 80, and guides the press sleeve 82. The press sleeve 82 is supported against the inner carrier 86 directly through the sleeve of the hollow carrier 80 by the two support devices 84.

Each support device 84 includes at least one press shoe 88 guided on the outer hollow carrier 80 and a plurality of support elements 90 disposed in a group and perpendicular to the direction of travel L of the web. The press shoe 88 is supported directly against the inner carrier 86. The support elements 90 have pistons 92 disposed radially inward. The pistons 92 may be disposed on or in the inner carrier 86. On the radially outward end, each support elements 90 is coupled with the press shoe 88 by a respective joint. The support forces applied by the two support devices 84 are preferably variable and, for example, may also be separately adjustable, in particular by a Delta-P-valve 94, shown in FIG. 7. In the present embodiment, no additional support device is provided other than the two support devices 84. Additionally, the hollow carrier 80 and the inner carrier 86 are equidistantly mounted on their ends.

To support the centrifuging of water, the press sleeve 40 may again be in the form of a polygon, specifically, between the two elongated press nips S1 and S2. In addition, the press system shown in FIG. 7 has a structure substantially comparable to that of FIG. 1. In particular, a closed web path is also provided. It is, in principle, possible to feed the fibrous material web 10 downstream of the second elongated press nip S2 according to the embodiment in FIG. 1 over the outer circumference of the mating roll 24 as well as over an offset press of the drying section including the two rolls 26 and 28, as shown in FIG. 1.

In FIG. 7, an additional alternative web path is shown. The fibrous material web 10 is first guided between the two elongated press nips S1 and S2 formed with the shoe press roll 78 around a deflecting roll 36, which is designed as a suction roll (also shown in FIG. 1). In contrast to the embodiment according to FIG. 1, in the present case, a transfer felt or belt 96 is guided through the second elongated press nip S2 viewed in the direction of travel of the web L formed with the shoe press roll 78. Downstream of the second elongated press nip S2, the fibrous material web 10 is guided over a deflecting roll 98 (which is designed as a suction roll) to the drying section. Only the first drying cylinder 34 is shown in FIG. 7.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A press roll for the treatment of a fibrous material web, the press roll forming at least one nip with a respective mating surface, comprising:

a non-rotatably mounted carrier;

a press sleeve surrounding said carrier;

at least one outer support device disposed between said carrier and said press sleeve, said press sleeve being supported against the carrier at a respective at least one press nip; and a sagging control system adapted to control the sagging of said carrier at least by compensating for sagging produced by the forces in the region of said at least one press nip, wherein said sagging control system is configured to act in a direction different than the direction of the forces in the region of said at least one press nip.

2. The press roll according to claim 1, further comprising at least one inner carrier disposed within said carrier, and wherein said sagging control system comprises a mutual radial bracing device adapted to brace said carrier and said inner carrier.

3. The press roll according to claim 2, wherein said mutual radial bracing device braces said carrier and said inner carrier by at least one of hydraulics, pneumatics, mechanics, thermal, and electromagnetics.

4. The press roll according to claim 1, wherein:

said carrier is an outer hollow carrier having a non-rotatably mounted inner carrier disposed therein; and sagging control system comprises a mutual radial bracing device adapted to brace said outer hollow carrier and said inner carrier.

5. The press roll according to claim 4, wherein said mutual radial bracing device braces said carrier and said inner carrier by at least one of hydraulics, pneumatics, mechanics, thermal, and electromagnetics.

6. The press roll according to claim 5, wherein said sagging control system includes at least one inner support device disposed between said hollow carrier and said inner carrier.

7. The press roll according to claim 6, wherein said inner support device includes at least one group of inner support device support elements perpendicularly extending relative to a direction of travel of the web.

8. The press roll according to claim 4, wherein said hollow carrier and said inner carrier are each mounted on their respective ends at a point equidistant from each other.

9. The press roll according to claim 1 wherein said press sleeve is a flexible press sleeve and is designed as a shoe press roll.

10. The press roll according to claim 7, wherein:

said inner support device includes at least one group of inner support device support elements perpendicularly extending relative to a direction of travel of the web; and said inner carrier support elements and said outer support device support elements each include at least one cylinder/piston unit.

11. The press roll according to claim 7, wherein said group of outer support device support elements and said inner support device have the same pitch and further each have pistons having the same piston area.

12. The press roll according to claim 1, wherein said press sleeve is guided offset relative to said carrier.

13. The press roll according to claim 1, wherein said press sleeve is blind drilled.

14. The press roll according to claim 1, wherein said press sleeve is grooved.

15. A press roll for the treatment of a fibrous material web, the press roll forming at least one nip with a respective mating surface, comprising:

a press roll a non-rotatably mounted carrier;

a press sleeve surrounding said carrier;

at least two outer support devices disposed between said carrier and said press sleeve, said press sleeve being supported against the carrier at a respective at least one press nip, and a space extending between said at least two outer support devices in a circumferential direction of the press roll;

at least one outer support device; and a sagging control system adapted to control the sagging of said carrier;

wherein:

said press sleeve is supported against said carrier, to form at least two press nips with respective mating surfaces; and sagging of the carrier is controlled by said sagging control system, wherein sagging resulting from different directional pressing forces is compensated.

16. A press roll for the treatment of a fibrous material web, the press roll forming at least one nip with a respective mating surface, comprising:

a non-rotatably mounted carrier;

a press sleeve surrounding said carrier;

a sagging control system adapted to control the sagging of said carrier; and at least one outer support device disposed between said carrier and said press sleeve, said press sleeve being supported against the carrier at a respective at least one press nip, wherein said at least one outer support device comprises:

a) at least one press shoe; and b) a plurality of outer support device support elements disposed in a group perpendicularly extending relative to a direction of travel of the web.

17. A press roll for the treatment of a fibrous material web, the press roll forming at least one nip with a respective mating surface, comprising:

a non-rotatably mounted carrier;

a press sleeve surrounding said carrier;

at least one outer support device disposed between said carrier and said press sleeve, said press sleeve being supported against the carrier at a respective at least one press nip; and a sagging control system adapted to control the sagging of said carrier; and at least one inner support device disposed between said carrier and said inner carrier, said inner support device being configured to apply a force and act in a predetermined direction, wherein sagging of the carrier is controlled by said sagging control system, wherein sagging resulting from different directional pressing forces is compensated; and wherein:

said at least one nip includes at least two nips;

said at least one outer support device includes two outer support devices having a space extending therebetween in a circumferential direction of the press roll; and said two outer support devices being disposed between said carrier and said press sleeve, each said two outer support devices being configured to apply a force and act in a predetermined direction, said press sleeve being supported against said carrier in the region of said at least two press nips, said at least two press nips be formed with a respective mating surface.

18. The press roll according to claim 17, wherein said direction of action of said inner support device lies in a resultant direction of action of said two outer support devices.

19. The press roll according to claim 17, each said force applied by said two outer support devices have the same magnitude.

20. The press roll according to claim 17, wherein each of said at least two outer support devices are configured to act in a radial direction, wherein said radial directions of action of said at least two outer support devices are offset by approximately 120°.

21. The press roll according to claim 20, wherein the forces applied by said at least two outer support devices and the force applied by said inner support device are at least substantially the same magnitude and form an equilateral triangle of forces.

22. The press roll according to claim 17, wherein the forces applied by said two outer support devices are at least substantially of the same magnitude and form an isosceles triangle of forces with the force applied by the inner support device.

23. The press roll according to claim 22 wherein the total piston area of the inner support device is adapted to generate a force at least substantially compensating the force resulting from the at least two outer support devices.

24. The press roll according to claim 22, wherein said group of support elements of said two outer support devices have the same pitch and their support elements each have pistons having the same piston area.

25. The press roll according to claim 24, wherein the total piston area of the inner support device is adapted to generate a force at least substantially compensating the force resulting from the at least two outer support devices.

26. The press roll according to claim 25, wherein the individual piston areas of the inner support device support elements are the same size as the individual piston areas of the support elements of said at least two outer support devices, and wherein the total piston area of the inner support device is determined by the number of the inner support device support elements.

27. The press roll according to claim 24, wherein the piston pitch spacing of the inner support devices is the same as that of said at least two outer support devices wherein the total piston area of the inner support device is determined by the size of the individual piston areas.

28. The press roll according to claim 17, wherein the direction of action of the inner support device lies in the bisector of the angle between said at least two radial directions of action of said at least two outer support devices.

29. The press roll according to claim 17, wherein forces applied by said at least two outer support devices have different magnitudes and form a scalene triangle of forces with the forces applied by the inner support device.

30. The press roll according to claim 29, wherein the group of support elements of said at least two outer support devices have an unequal pitch.

31. The press roll according to claim 29, wherein the support elements of said at least two outer support devices have different sized piston areas.

32. The press roll according to claim 29 wherein the entire piston area of the inner support device is adapted to generate a force at least substantially compensating for the force resulting from said at least two outer support devices.

33. The press roll according to claim 29 wherein each of said at least two outer support devices comprises at least one press shoe, each said press shoe having an equal width extending in the direction of travel of the web.

34. The press roll according to claim 17, wherein said at least two outer support devices and said inner support device each have variably adjustable pressure.

35. The press roll according to claim 34, further comprising sleeve guide rails disposed intermediate said carrier and said press sleeve, wherein the forces applied by said at least two outer support devices and said inner support device are maintained in equilibrium by individual pressures acting on said outer support device support elements and said sleeve guide.

36. A press system for treatment of a fibrous material web comprising:

a) a shoe press roll comprising:

1) a non-rotatably mounted carrier;

2) a press sleeve surrounding said carrier;

3) at least two outer support devices disposed between said carrier and said press sleeve; and 4) a sagging control system adapted to control the sagging of said carrier;

b) a first mating roll; and c) a second mating roll;

wherein said shoe press roll mates with said first mating roll to form a first press nip therebetween, and said shoe press roll mates with said second mating roll to form a second press nip therebetween, said first press nip and said second press nip elongated in a direction of travel of the web.

37. The press system according to claim 36, further comprising a completely closed web path.

38. The press system according to claim 36, further comprising a felt adapted for guidance between said-first and second press nips.

39. The press system according to claim 36, further comprising a pickup felt adapted for guidance through said first press nip.

40. The press system according to claim 36, wherein said pickup felt is further adapted for guidance through said second press nip.

41. The press system according to claim 36, further comprising a deflecting roll, wherein said first press nip and said second press nip are each adapted to guide the web therethrough, and wherein said deflecting roll is adapted to guide the web therearound.

42. The press system according to claim 41, wherein said deflecting roll is a suction roll.

43. The press system according to claim 36, further comprising a deflecting roll and a drying section, wherein said second press nip is adapted to guide the web and a transfer felt therethrough, and wherein said deflecting roll is adapted to guide the web and said transfer felt therearound.

44. The press system according to claim 43, wherein said deflecting roll is a suction roll.

45. The press system according to claim 36, wherein at least one of said press nips is double felted.

46. The press system according to claim 45, wherein said first and said second press nips are double felted.

47. The press system according to claim 36, wherein at least one of said press sleeve, said first mating roll and said second mating roll are at least one of blind drilled and grooved.

48. The press system according to claim 47, wherein at least one press nip is adapted for drainage at least partially by centrifugation into at least one channel.

49. The press system according to claim 36, further comprising an offset roll, wherein said second mating roll forms a third press nip, with said offset roll.

50. The press system according to claim 49, wherein said offset roll is a shoe press roll, and said third press nip is elongated in the direction of travel of the web.

51. The press system according to claim 36, wherein said second mating roll is adapted to be heated, thereby facilitating the drainage of the web in said second press nip and said third press nip, and further facilitating the release of the web from said second mating roll.

52. The press system according to claim 41 further comprising a heating system adapted to heat said deflecting roll, thereby increasing drainage performance of said second press nip.

53. The press system according to claim 36, wherein said press sleeve is flexible.

54. A press roll for the treatment of a fibrous material web, the press roll forming at least one nip with a respective mating surface, comprising:

a non-rotatably mounted bimetal carrier;

a press sleeve surrounding said carrier;

at least one outer support device disposed between said carrier and said press sleeve, said press sleeve being supported against the carrier at a respective at least one press nip; and a sagging control system configured to control the sagging of said carrier and comprising a heating system adapted to heat said carrier.

55. A press roll for the treatment of a fibrous material web, the press roll forming at least one nip with a respective mating surface, comprising:

a non-rotatably mounted slotted carrier;

a press sleeve surrounding said slotted carrier;

at least one outer support device disposed between said slotted carrier and said press sleeve, said press sleeve being supported against the slotted carrier at a respective at least one press nip; and a sagging control system adapted to control the sagging of said slotted carrier and comprising a brace configured to brace said slotted carrier.

* * * * *